US008449146B2

(12) United States Patent
Chen

(10) Patent No.: US 8,449,146 B2
(45) Date of Patent: May 28, 2013

(54) LED LAMP ASSEMBLY FOR USE IN A LONG PASSAGE

(75) Inventor: Chi-Lin Chen, Taipei (TW)

(73) Assignee: USTA Co., Ltd., Taipei (TW)

( * ) Notice: Subject to any disclaimer, the term of this patent is extended or adjusted under 35 U.S.C. 154(b) by 208 days.

(21) Appl. No.: 13/156,988

(22) Filed: Jun. 9, 2011

(65) Prior Publication Data

US 2012/0314416 A1 Dec. 13, 2012

(51) Int. Cl.

| | |
|---|---|
| ***F21S 4/00*** | (2006.01) |
| ***F21S 8/00*** | (2006.01) |
| ***F21V 21/00*** | (2006.01) |
| ***F21L 19/00*** | (2006.01) |
| ***F21L 4/04*** | (2006.01) |

(52) U.S. Cl.

USPC ... 362/249.05; 362/177; 362/199; 362/249.1; 362/427

(58) Field of Classification Search

USPC ..... 362/249.05, 177, 199, 249.1, 427

See application file for complete search history.

(56) References Cited

U.S. PATENT DOCUMENTS

| | | | | |
|---|---|---|---|---|
| 6,042,068 | A * | 3/2000 | Tcherny | 248/221.11 |
| 7,338,189 | B2 * | 3/2008 | Kovacik et al. | 362/398 |
| 7,703,966 | B2 * | 4/2010 | Waters | 362/577 |
| 8,029,173 | B2 * | 10/2011 | Ko | 362/427 |
| 8,104,928 | B1 * | 1/2012 | Horn | 362/287 |
| 2002/0191396 | A1 * | 12/2002 | Reiff et al. | 362/246 |

* cited by examiner

*Primary Examiner* — David J Makiya
(74) *Attorney, Agent, or Firm* — Guice Patents PLLC

(57) ABSTRACT

A LED lamp assembly for use in a long passage includes an elongated rectangular housing carrying multiple power-output electric connectors, a power-input electric connector and a power switch, a flat rectangular light source having a light-emitting face and selectively fastened to a rectangular top end of housing in one of four angular positions that spaced from one another at 90° angle, and a mounting plate extending perpendicularly from one side of the rectangular end wall of the housing having a plurality a plurality of equiangularly spaced and smoothly arched mounting slots for mounting.

7 Claims, 7 Drawing Sheets

LED LAMP ASSEMBLY FOR USE IN A LONG PASSAGE

BACKGROUND OF THE INVENTION

1. Field of the Invention

The present invention relates to lighting fixtures and more particularly, to a LED lamp assembly practical for use in a tower of a wind power system or a subway tunnel.

2. Description of the Related Art

For illumination or direction indication in a long passage, a lighting fixture must be installed. Conventional lighting fixtures commonly use a fluorescent lamp tube as the main light source. In a long passage, for example, in a tower of a wind power system or a subway tunnel, the air is frequently disturbed. A fluorescent lamp tube can easily be damaged by vibration when used in a place where the air is frequently disturbed.

Nowadays, LED technology for lighting has matured. However, a LED lamp simply has one light-emitting face for illumination. When multiple LED lamps are installed in a long passage, the light-emitting face is not adjustable. This limitation complicates the installation, wasting much labor and time.

SUMMARY OF THE INVENTION

The present invention has been accomplished under the circumstances in view. It is the main object of the present invention to provide a LED lamp assembly for use in a long passage, which facilitates installation and allowing selective positioning of the light-emitting face of the light source in one of four angular positions that spaced from one another at 90° angle.

To achieve this and other objects of the present invention, the LED lamp assembly comprises a housing, which comprises a rectangular end wall located on the top end thereof, a plurality of electric connectors and a power switch, a light source, which is a flat rectangular member comprising a light-emitting face, a circuit board mounted therein and carrying a control circuit and an array of light emitting diodes controllable by the control circuit adapted to emit light through the light-emitting face and a rectangular end plate located on the bottom end thereof and selectively fastened to the rectangular end wall of the housing in one of four angular positions that spaced from one another at 90° angle, and a mounting plate, which extends perpendicularly from one side of the rectangular end wall of the housing and has a plurality a plurality of mounting slots for mounting.

Further, the mounting slots of the mounting plate are elongated and smoothly arched mounting slots cut through two opposite sides of the mounting plate and equiangularly spaced from one another so that the LED lamp assembly can be installed in a support member in a long passage in a tilted condition.

In an alternate form of the present invention, the housing comprises two sliding grooves arranged in a parallel manner at one peripheral wall thereof and extending along the length; the mounting plate comprises four angled coupling potions respectively extended from the four corners thereof and respectively slidably coupled to the sliding grooves.

The LED lamp assembly of the present invention has the advantages of anti-vibration, long durability and lower power consumption, and therefore it is practical for use in a subway tunnel where the air is frequently disturbed.

BRIEF DESCRIPTION OF THE DRAWINGS

Other and further benefits, advantages and features of the present invention will be fully understood by reference to the following specification in conjunction with the accompanying drawings, in which.

DETAILED DESCRIPTION OF THE INVENTION

The various objects and advantages of the present invention will be more readily understood from the following detailed description of four embodiments when read in conjunction with the appended drawings, in which like reference numbers denote like elements of structure.

Figure 1:
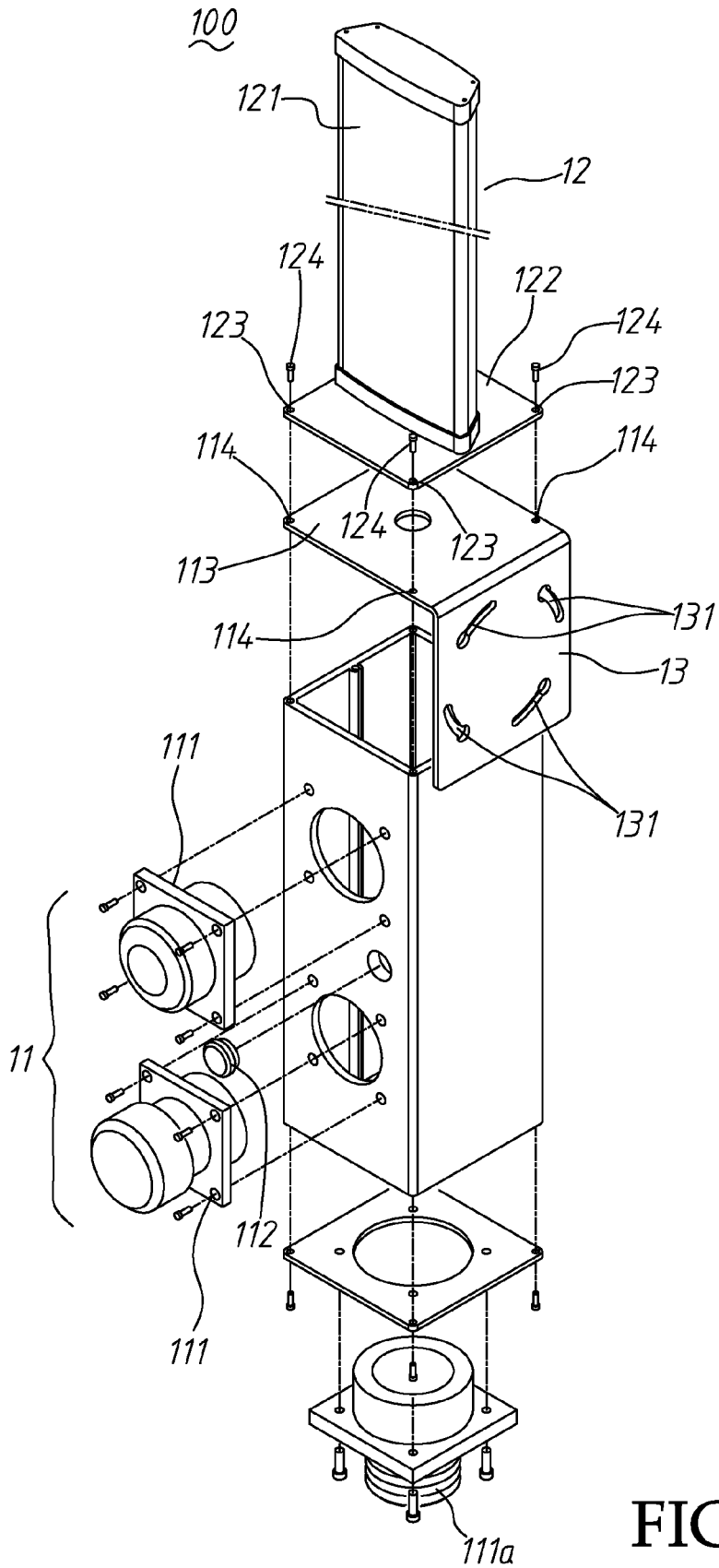
FIG. 1 is an exploded view of a LED lamp assembly in accordance with a first embodiment of the present invention.
Figure 2:
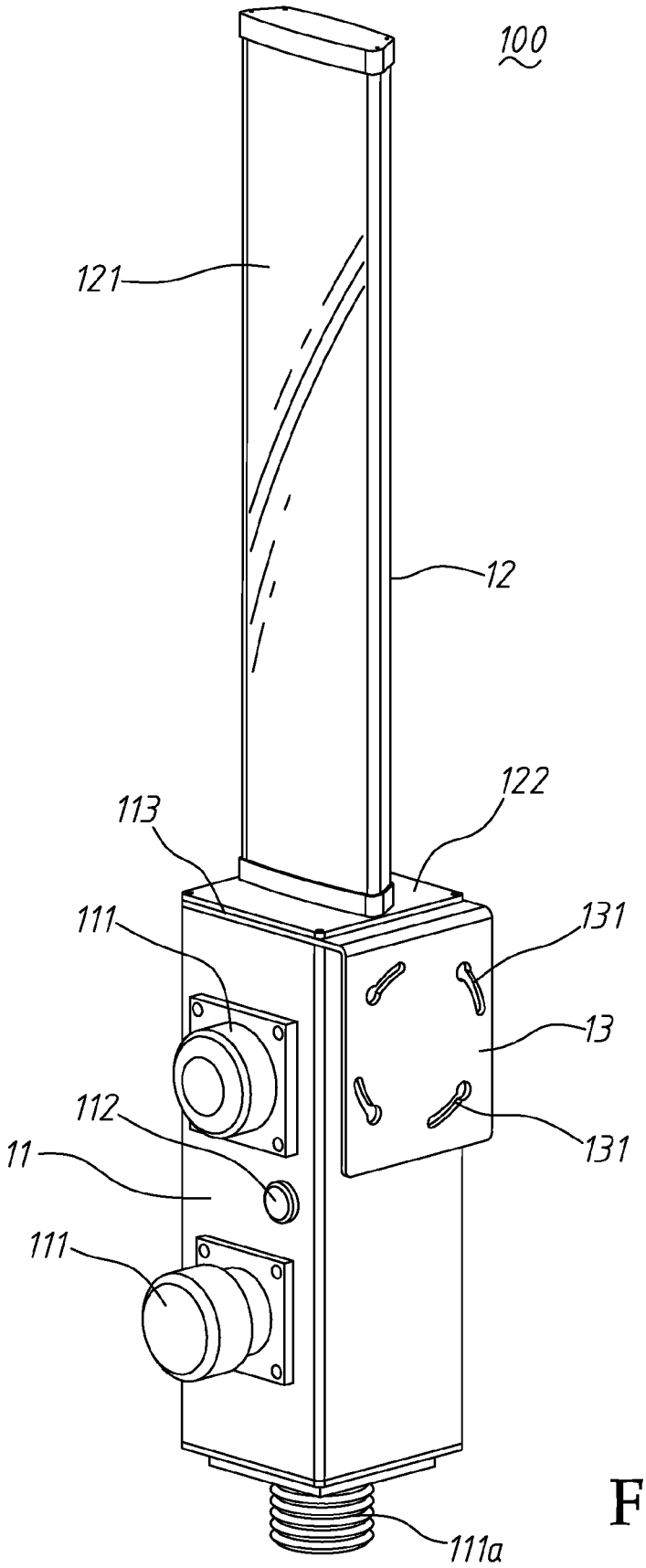
FIG. 2 is an elevational assembly view of the LED lamp assembly in accordance with the first embodiment of the present invention.

Referring to FIGS. 1 and 2, a LED lamp assembly 100 in accordance with a first embodiment of the present invention is shown comprising a housing 11, a light source 12 and a mounting plate 13.

Figure 3:
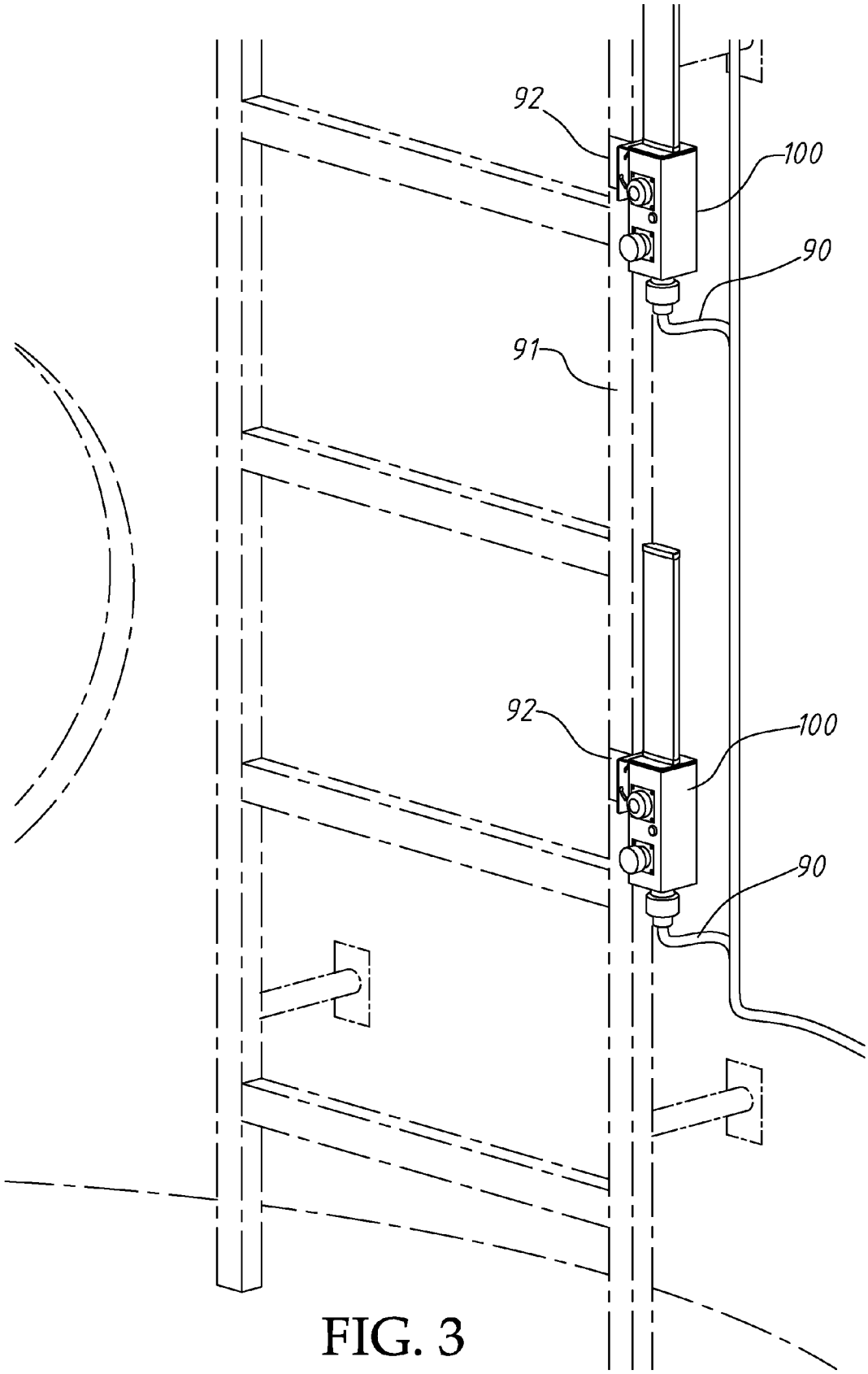
FIG. 3 is an applied view of the first embodiment of the present invention, illustrating the LED lamp assembly installed in a tower of a wind power system.
Figure 4:
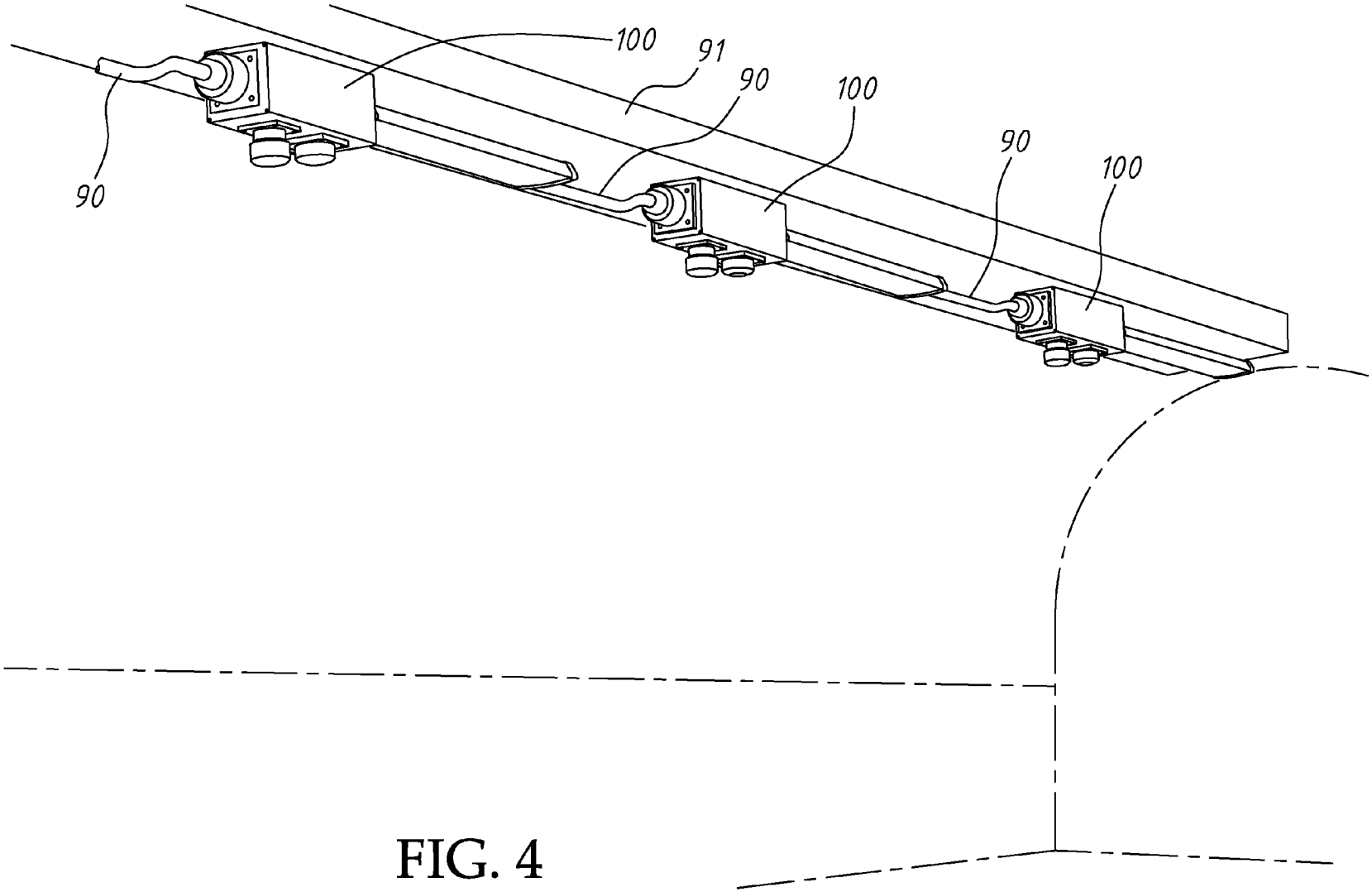
FIG. 4 is another applied view of the first embodiment of the present invention, illustrating the LED lamp assembly installed in a subway tunnel.
Figure 5:
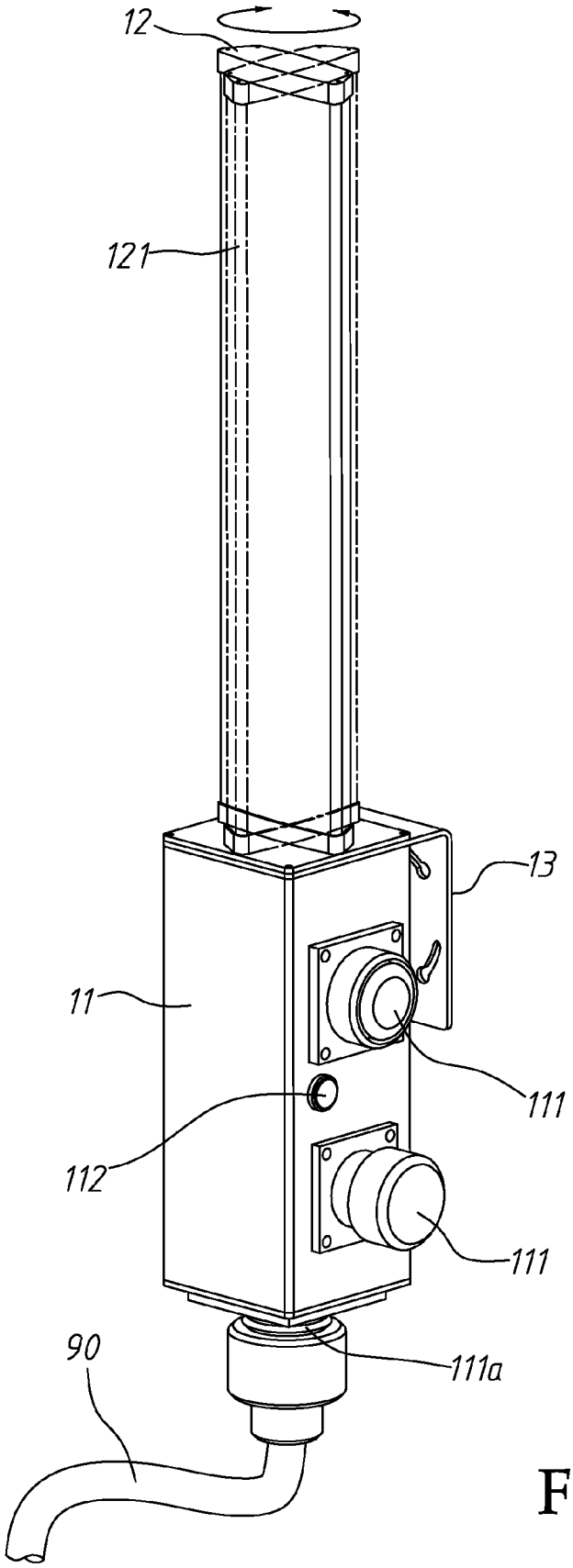
FIG. 5 is a schematic drawing of the first embodiment of the present invention, illustrating selective installation of the light source in one of four angular positions relative to the housing.
Figure 6:
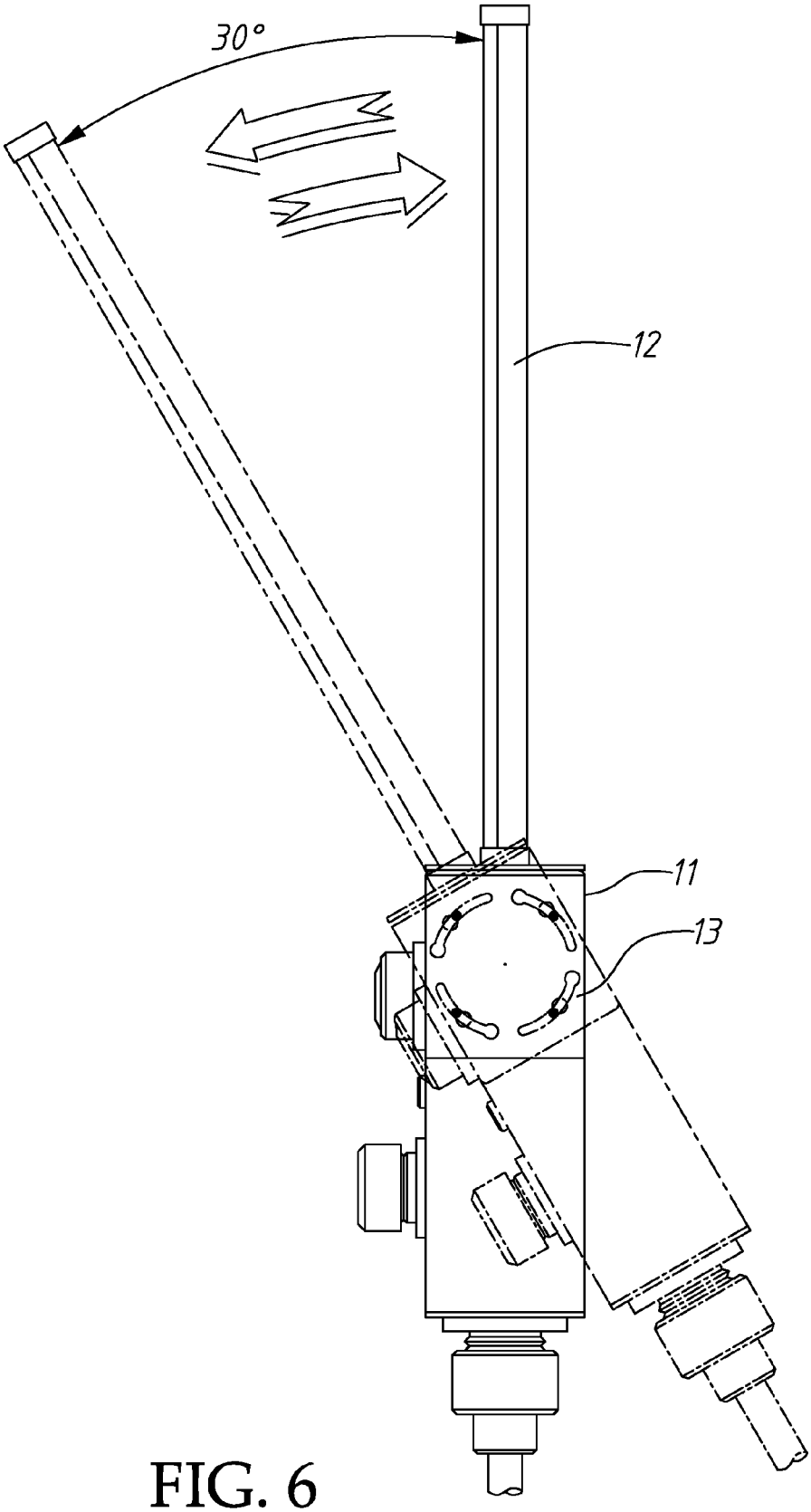
FIG. 6 is a schematic drawing of the first embodiment of the present invention, illustrating adjustment of tilting angle of the LED lamp assembly during installation.

The housing 11 is a hollow, elongated, rectangular case having a rectangular end wall 113 located on one end, namely, the top end thereof and holding a plurality of power-output electric connectors 111 and a power switch 112 at one of the four peripheral sides thereof and a power-input electric connector 111*a* at the other end, namely, the bottom end thereof The power-input electric connector 11*a* is a power jack for the connection of a power cable 90 for power supply input (see FIGS. 3 and 4). The power-output electric connectors 111 are adapted for the connection of one respective power cable for power supply output. Further, the rectangular end wall 113 has a plurality of mounting holes 114 respectively located on the four corners thereof The light source 12 is a flat rectangular member having a light-emitting face 121 and holding on the inside a circuit board with an array of LEDs and a control circuit (not shown). Light emitted by the LEDs goes through the light-emitting face 121 toward the outside. Further, a rectangular end plate 122 is located on one end, namely, the bottom end of the light source 12 and fastened to the rectangular end wall 113 of the housing 11. The rectangular end plate 122 of the light source 12 can be selectively fastened to the rectangular end wall 113 of the housing 11 in one of four angular positions that spaced from one another at 90° angle (see the imaginary lines in FIG. 5). The rectangular end plate 122 of the light source 12 has a through hole 123 at each of the four corners thereof and respectively fastened to the mounting holes 114 of the rectangular end wall 113 of the housing 11 with a respective screw 124. This installation procedure is quite simple, allowing the user to selectively set the light-emitting face 121 in one of four angular positions that spaced from one another at 90° angle.

According to the embodiment shown in FIGS. 1 and 2, the mounting plate 13 extends perpendicularly from one side of the rectangular end wall 113 of the housing 11 in a parallel manner relative to the housing 11, having four elongated and smoothly arched mounting slots 131 cut through two opposite sides thereof and equiangularly spaced from one another. Thus, the mounting plate 13 can be fastened to a selected place with fastening members 92 and adjusted to any angular position within a predetermined range, for example, 30° angle before tightening up the fastening members 92. The adjustable range of the angular position is determined subject to the extending angle of the elongated and smoothly arched mounting slots 131.

As stated above, the LED lamp assembly 100 of the present invention allows the user to adjust the angular position of the light-emitting face 121 of the light source 12 to one of four angular positions relative to the housing 11. Further, the installation of the LED lamp assembly 100 is quite simple. Anybody can install the LED lamp assembly 100 without special training.

FIG. 3 illustrates an application example of the LED lamp assembly 100 in a wind turbine tower of a wind power system, wherein the reference number 91 indicates a ladder in the wind turbine tower. FIG. 4 illustrates another application example of the LED lamp assembly 100 in a subway tunnel. As the air in a subway tunnel is frequently disturbed, a conventional fluorescent lamp can be easily damaged by vibration when used in a subway tunnel. The LED lamp assembly of the present invention has the advantages of anti-vibration, long durability and lower power consumption.

Figure 7:
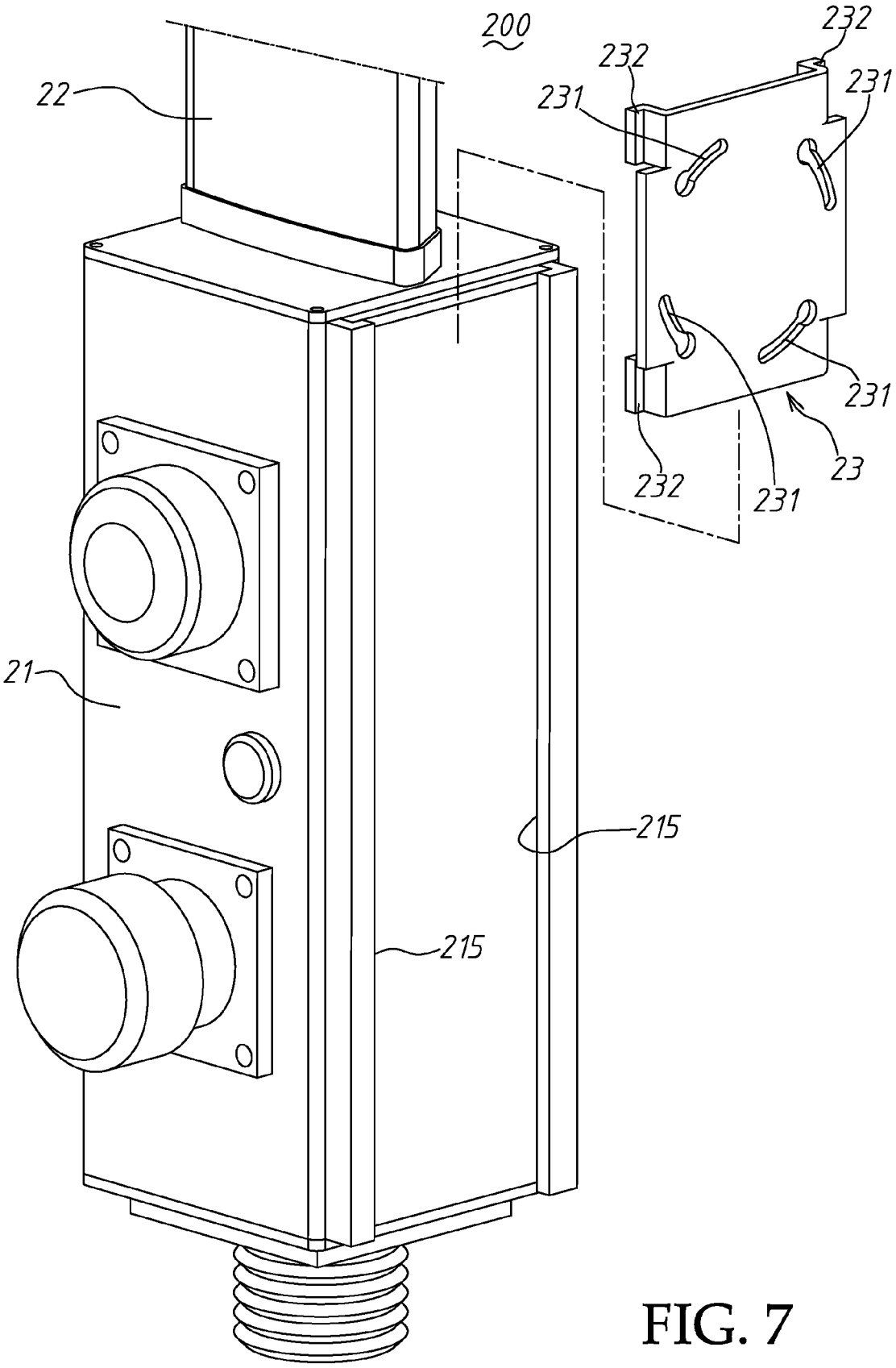
FIG. 7 is an exploded view of a LED lamp assembly in accordance with a second embodiment of the present invention.

FIG. 7 illustrates a LED lamp assembly 200 in accordance with a second embodiment of the present invention. This second embodiment is substantially similar to the aforesaid first embodiment, comprising a housing 21, a light source 22 and a mounting plate 23. According to this second embodiment, the housing 21 comprises two sliding grooves 215 arranged in a parallel manner at one peripheral wall thereof and extending along the length; the mounting plate 23 comprises four angled coupling potions 232 respectively extended from the four corners thereof and respectively slidably coupled to the sliding grooves 215, and four elongated and smoothly arched mounting slots 231 cut through two opposite sides thereof and equiangularly spaced from one another. This second embodiment achieves the same effects as the aforesaid first embodiment.

Although particular embodiment of the invention have been described in detail for purposes of illustration, various modifications and enhancements may be made without departing from the spirit and scope of the invention. Accordingly, the invention is not to be limited except as by the appended claims.

What is claimed is:

1. A LED lamp assembly, comprising:

a housing comprising a rectangular end wall located on a top end thereof, a plurality of electric connectors and a power switch;

a light source being a flat rectangular member, said light source comprising a light-emitting face, a circuit board mounted therein and carrying a control circuit and an array of light emitting diodes controllable by said control circuit adapted to emit light through said light-emitting face, and a rectangular end plate located on a bottom end thereof and selectively fastened to said rectangular end wall of said housing in one of four angular positions that are spaced from one another at 90° angles; and a mounting plate extending perpendicularly from one side of said rectangular end wall of said housing, said mounting plate comprising a plurality of mounting slots for mounting.

2. The LED lamp assembly as claimed in claim 1, wherein one of said electric connectors is a power-input connector located on a bottom end of said housing opposite to said rectangular end wall for the connection of an external power cable for power supply input.

3. The LED lamp assembly as claimed in claim 2, wherein the other said electric connectors are power-output connectors located on one of four peripheral sides of said housing and electrically connected to said power-input connector through said power switch and controllable by said power switch for power output.

4. The LED lamp assembly as claimed in claim 3, wherein said rectangular end wall of said housing comprises a mounting hole at each of the four corners thereof; said rectangular end plate of said light source comprises a through hole at each of the four corners thereof and respectively fastened to the mounting holes of said rectangular end wall of said housing with a respective screw.

5. The LED lamp assembly as claimed in claim 2, wherein said mounting slots of said mounting plate are elongated and smoothly arched mounting slots cut through two opposite sides of said mounting plate and equiangularly spaced from one another.

6. The LED lamp assembly as claimed in claim 2, wherein said housing comprises two sliding grooves arranged in a parallel manner at one peripheral wall thereof and extending along the length; said mounting plate comprises four angled coupling potions respectively extended from the four corners thereof and respectively slidably coupled to said sliding grooves.

7. The LED lamp assembly as claimed in claim 6, wherein said mounting slots of said mounting plate are elongated and smoothly arched mounting slots cut through two opposite sides of said mounting plate and equiangularly spaced from one another.

* * * * *